US009726183B2

(12) United States Patent
Semple et al.

(10) Patent No.: US 9,726,183 B2
(45) Date of Patent: Aug. 8, 2017

(54) SYSTEMS AND METHODS FOR PREVENTING DAMAGE TO PUMP DIFFUSERS

(71) Applicant: Baker Hughes Incorporated, Houston, TX (US)

(72) Inventors: Ryan P. Semple, Owasso, OK (US); Josh S. Ledbetter, Tulsa, OK (US); Peter F. Lawson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 817 days.

(21) Appl. No.: 13/801,497

(22) Filed: Mar. 13, 2013

(65) Prior Publication Data

US 2014/0271107 A1 Sep. 18, 2014

(51) Int. Cl.

| | |
|---|---|
| ***F04D 13/10*** | (2006.01) |
| ***F04D 15/00*** | (2006.01) |
| ***F04D 29/44*** | (2006.01) |

(52) U.S. Cl.

CPC ..... *F04D 13/10* (2013.01); *F04D 15/0083* (2013.01); *F04D 29/448* (2013.01)

(58) Field of Classification Search

CPC ..... F04D 13/10; F04D 15/0083; F04D 29/448
See application file for complete search history.

(56) References Cited

U.S. PATENT DOCUMENTS 4,993,921 A * 2/1991 Taplin ..... F04B 1/324 137/493.9
2012/0205112 A1* 8/2012 Pettigrew ..... E21B 43/26 166/308.1

FOREIGN PATENT DOCUMENTS

SU 1078134 A1 * 3/1984

OTHER PUBLICATIONS

SU 1078134 Abstract English Language Translation.*
Russian patent SU 1078134 translation.*

* cited by examiner

*Primary Examiner* — Mark Laurenzi
*Assistant Examiner* — Wesley Harris
(74) *Attorney, Agent, or Firm* — Law Offices of Mark L. Berrier

(57) ABSTRACT

Systems and methods for preventing diffusers in pumps such as electric submersible pumps from bursting or collapsing in over-pressure and/or under-pressure conditions, where one or more diffusers in the pump includes check valves in the exterior diffuser wall. The check valves remain closed when a pressure differential between the diffuser interior and exterior is within a predetermined range, but open when the pressure differential between the diffuser interior and the interstitial space is outside the predetermined range to relieve overpressure and underpressure conditions. When the pressure differential returns to an acceptable range, the check valves close, preventing recirculation of fluid between the diffusers of the different stages. O-rings or other types of seals may be installed between each stage and the pump housing to provide some isolation of the external pressure on the diffuser of each stage.

11 Claims, 5 Drawing Sheets

SYSTEMS AND METHODS FOR PREVENTING DAMAGE TO PUMP DIFFUSERS

BACKGROUND

Field of the Invention

This invention relates generally to pumps, and more specifically to systems and methods for preventing diffusers in pumps such as electric submersible pumps from bursting or collapsing in over-pressure and/or under-pressure conditions.

Related Art

Oil and natural gas are often produced by drilling wells into oil reservoirs and then pumping the oil and gas out of the reservoirs through the wells. If there is insufficient pressure in the well to force these fluids out of the well, it may be necessary to use an artificial lift system in order to extract the fluids from the reservoirs. A typical artificial lift system employs an electric submersible pump which is positioned in a producing zone of the well to pump the fluids out of the well.

An electric submersible pump system includes a pump and a motor which drives the pump. The electric submersible pump system may also include seals, gauge packages and other components. The electric submersible pump system commonly utilizes a centrifugal pump that has multiple stages, each of which has an impeller and diffuser. The impeller spins, forcing fluids from the well radially outward and upward toward the diffuser. The diffuser converts the kinetic energy imparted by the impeller to pressure which drives the fluid upward. The diffuser typically also directs the fluid inward, toward the axis of the pump, where it can be passed to a subsequently positioned impeller.

Although electric submersible pump systems are designed to fit within the borehole of a well, and are typically less than ten inches wide, they may produce hundreds of horsepower. These systems may develop thousands of pounds per square inch of pressure, which may cause diffusers to burst. Conversely, when the systems have been operating and are stopped, underpressure conditions may develop within the diffusers, causing them to collapse.

It would therefore be desirable to provide systems and methods to prevent damage to diffusers that could result from overpressure and underpressure conditions.

SUMMARY OF THE INVENTION

This disclosure is directed to systems and methods for preventing damage to diffusers in systems such as electric submersible pumps, wherein one or more check valves selectively enable or disable fluid communication between the interiors of the diffusers and an interstitial space between the diffusers and the housings in which they are contained in response to pressure differentials between the diffuser interiors and the interstitial spaces.

In one particular embodiment, an electric submersible pump system has a motor and a pump, where the pump has one or more stages contained within a housing. Each stage includes an impeller and a diffuser, and each diffuser includes one or more check valves between an interior of the diffuser and an interstitial space between the diffuser and the pump housing. The check valves remain closed when a pressure differential between the diffuser interior and the interstitial space is within a predetermined range, but open when the pressure differential between the diffuser interior and the interstitial space is outside the predetermined range.

When the check valves are open, fluid communication is enabled between the diffuser interior and the interstitial space, thereby relieving overpressure and underpressure conditions. When sufficient fluid has been transferred between the diffuser interior and the interstitial space to bring the pressure differential back to an acceptable range, the check valves close, preventing recirculation of fluid between the diffusers of the different stages. O-rings or other types of seals may be installed between each stage and the pump housing to provide some isolation of the external pressure on the diffuser of each stage.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
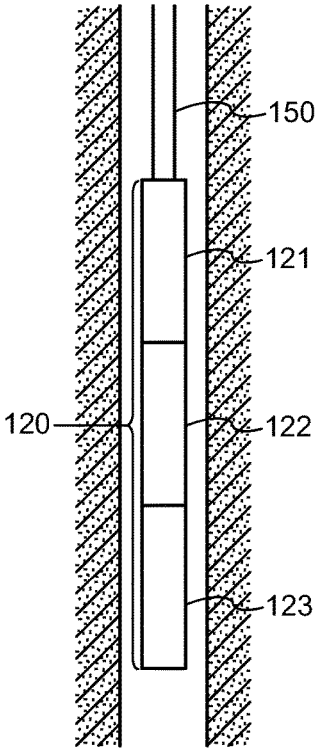
FIG. 1 is a diagram illustrating the components of an electric submersible pump system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

Various embodiments of the invention are described below. It should be noted that these and any other embodiments described below are exemplary and are intended to be illustrative of the invention rather than limiting.

As described herein, various embodiments of the invention comprise systems and methods for preventing damage to diffusers in, for example, electric submersible pumps. In the present systems and methods, one or more check valves are used to selectively enable or disable fluid communication between the interiors of a diffuser and an interstitial space between the diffuser and a housings in which it is contained. The check valves thereby prevent overpressure and underpressure conditions that could burst or collapse the diffuser, respectively. After the overpressure or underpressure conditions are alleviated, the check valve(s) reset, thereby preventing recirculation of well fluids between diffusers through the interstitial space and resulting erosion of the components of the pump system.

Embodiments of the invention may be implemented, for example, in electric submersible pump systems. Referring to FIG. 1, a diagram illustrating the components of an electric submersible pump system in one embodiment. In this embodiment, an electric submersible pump system is implemented in a well for producing oil, gas or other fluids. An electric submersible pump system 120 is coupled to the end of tubing string 150, and the electric submersible pump system and tubing string are lowered into the wellbore to position the pump in a producing portion of the well. A drive system (not shown) at the surface of the well provides power to the electric submersible pump system 120 to drive the system's motor.

Electric submersible pump system 120 includes a pump section 121, a seal section 122, and a motor section 123. Electric submersible pump system 120 may include various other components which will not be described in detail here because they are well known in the art and are not important to a discussion of the invention. Motor section 123 is coupled by a shaft through seal section 122 to pump section 121. Motor section 123 rotates the shaft, thereby driving pump section 121, which pumps the oil or other fluid through the tubing string 150 and out of the well.

Figure 2:
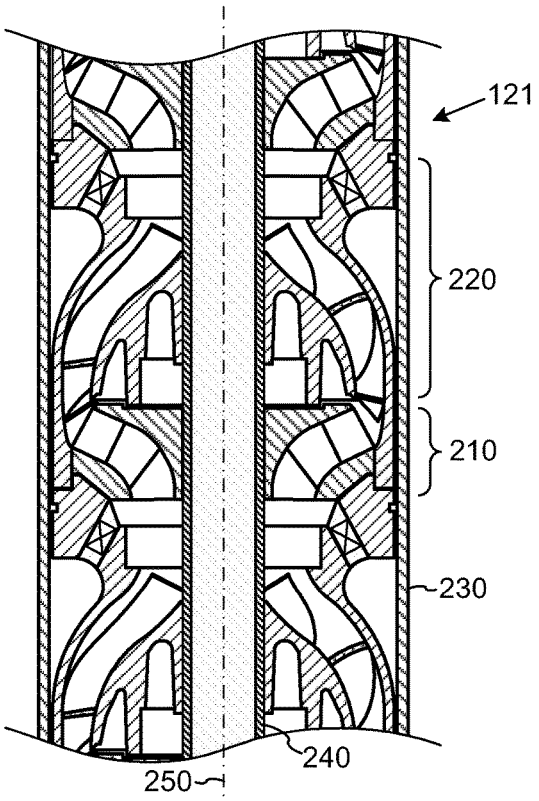
FIG. 2 is a diagram illustrating a portion of the internal structure of pump in accordance with one embodiment.

As noted above, a pump section of an electric submersible pump may include multiple stages, where each stage includes an impeller and a diffuser. FIG. 2 is a diagram illustrating a portion of the internal structure of pump 121 is shown. In this embodiment, pump 121 includes multiple impeller/diffuser stages. Each stage includes an impeller (e.g., 210) and a diffuser (e.g., 220). Each of the stages is contained within a pump housing 230. The impellers are coupled to shaft 240. Shaft 240 is rotated by motor 123, thereby rotating the blades of the impellers. The impeller of each stage receives well fluid (in the case of impeller 210, from a preceding diffuser) and propels the fluid radially outward and upward toward the stage's diffuser. The diffuser converts the kinetic energy imparted to the well fluid by the impeller to pressure as the fluid is directed radially inward.

For the purposes of this disclosure, "radially inward" refers to a direction or movement that is generally toward the axis (250) of the pump. The term "radially outward" refers to a direction or movement that is generally away from the axis of the pump.

Figure 3A:
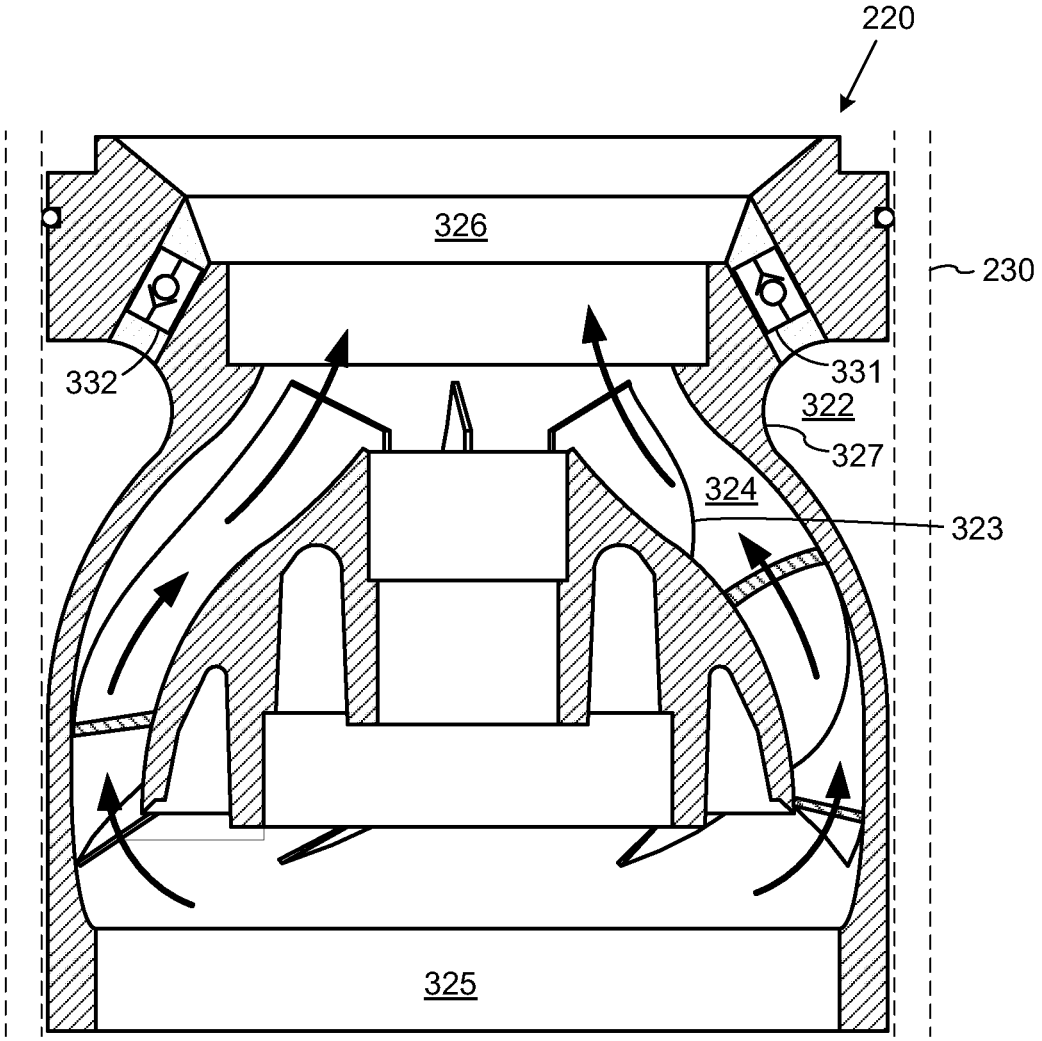
FIGS. 3A-3C are a set of diagrams illustrating in more detail the structure of a diffuser having two unidirectional check valves in accordance with one embodiment.
Figure 3B:
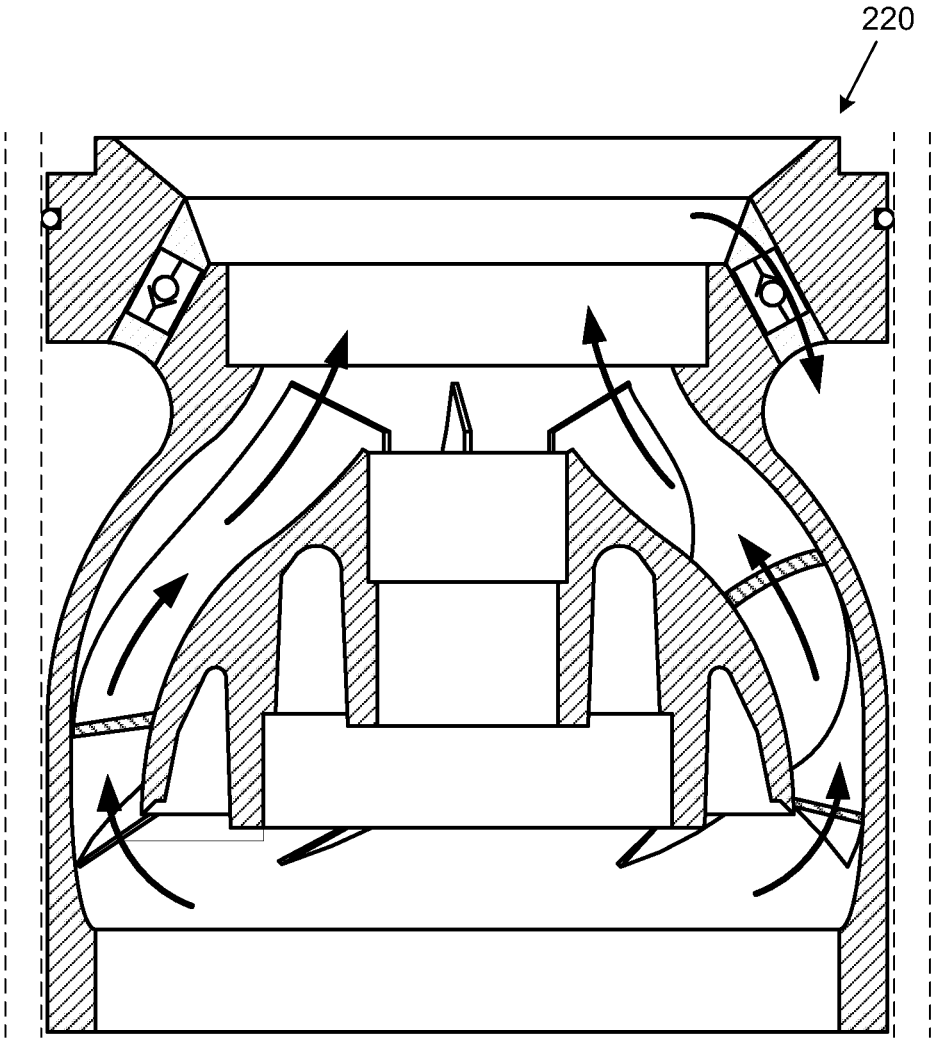
Figure 3C:
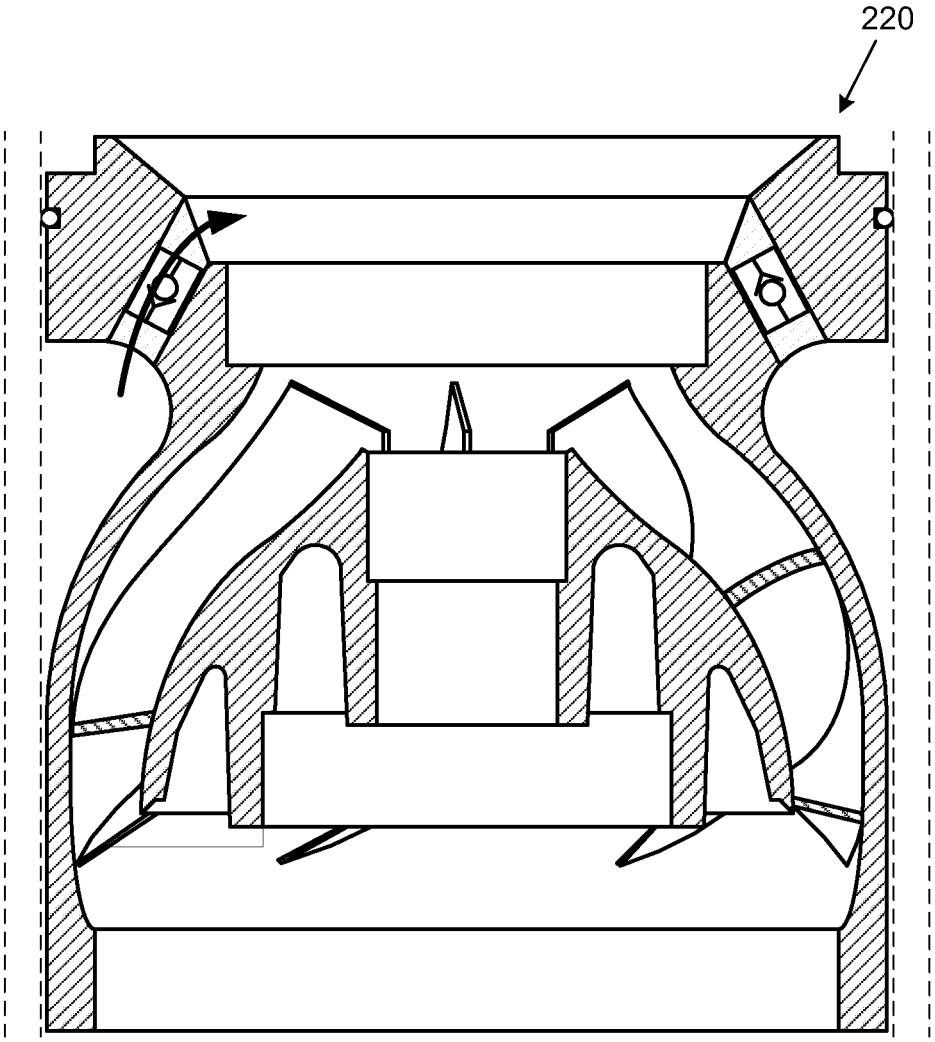

Referring to FIGS. 3A-3C, a set of diagrams illustrating in more detail the structure of a diffuser having two unidirectional check valves in accordance with one embodiment is shown. The structure of the diffuser is identical in FIGS. 3A-3C. FIG. 3A shows the diffuser with both check valves closed. FIG. 3B shows the diffuser with the outgoing check valve open and the incoming check valve closed. FIG. 3B shows the diffuser with the outgoing check valve closed and the incoming check valve open.

In FIGS. 3A-3C, diffuser 220 is shown apart from the impeller or other components of the pump. In normal operation, fluid enters a lower portion of diffuser 220 through a lower opening 325. The fluid is driven by an impeller to an outer annular portion of the opening, where it flows upward through several passageways (e.g., 324) through the diffuser (guided by vanes such as 323) to an upper opening 326. Typically, a subsequent impeller would be positioned near opening 326 to propel the fluid toward another diffuser.

As the fluid is driven through each impeller/diffuser stage, the pressure differential between the interior of a stage's diffuser and the interstitial space (between the diffuser's exterior wall and the pump housing) increases with each successive stage. While some conventional diffusers have male/female nesting features that allow some fluid to be communicated from the diffuser's interior to the interstitial space, this may not be sufficient in some cases to prevent an overpressure condition from developing. Depending upon the specific stage design and the loads created at assembly or during operation, the pressure differential may be great enough that the diffuser will burst.

In some instances, it may also be possible for underpressure conditions to develop. If a pump is driving fluid through the diffuser and operation of the pump is rapidly stopped, the pressure within the diffuser may suddenly decrease, while the pressure in the interstitial space remains the same. This may result in a negative pressure differential (where the pressure within the diffuser is less than the pressure in the interstitial space). If the negative pressure differential is great enough, the diffuser may collapse.

This problem has been addressed in some prior art systems through the use of a burst disk in the diffuser. In these systems, overpressure or underpressure conditions may be relieved by collapse of the burst disk in response to a large pressure differential. When the burst disk collapses, fluid is allowed to flow past the disk between the diffuser's interior and the interstitial space, equalizing the pressure. This solution, has a number of drawbacks, however, such as the fact that, once the burst disk has collapsed, fluid can continue to flow past the disk, recirculating fluid between the diffusers and reducing the efficiency of the system. The recirculation is also likely to cause erosion of the pump components as it recirculates through the interstitial space.

Another problem with this solution is that it requires removal of the o-rings at each stage. Normally, the o-rings provide some isolation of the pressures in the interstitial spaces outside each diffuser. In other words, the pressure increases in the interstitial space outside each successive diffuser, reducing the pressure differential between each diffuser and the adjoining interstitial space. When the o-rings are removed, however, the interstitial space adjoining each diffuser is at the full pressure developed by the pump, thereby exposing the diffusers of earlier stages to greater pressure differentials and greater risk of collapsing.

In the present systems and methods, resettable check valves are provided to selectively enable fluid communication between the interior of each diffuser and the interstitial space adjacent to the diffuser. In the embodiment of FIG. 3A, two unidirectional check valves (331, 332) are provided in the outer wall 327 of diffuser 220. Each of the check valves is configured to remain closed until the pressure differential between the interior of the diffuser and the interstitial space reaches a threshold level. When the threshold for one of the valves is exceeded, the vale opens, allowing fluid to flow between the between the interior of the diffuser and the interstitial space, thereby reducing the pressure differential and preventing the burst or collapse of the diffuser. After the pressure differential falls below the threshold, the valve closes, preventing further flow of fluid between the interior of the diffuser and the interstitial space Check valve 331 is positioned to allow fluid to flow out of the diffuser (i.e., from the interior of the diffuser to the interstitial space) when the valve is open. Check valve 332 is positioned to allow fluid to flow into the diffuser (i.e., from the interstitial space to the interior of the diffuser) when the valve is open. Each of the valves may be configured to be closed when the pressure differential between the interior of the diffuser and the interstitial space is below a predetermined threshold, and open when the pressure differential is above the threshold. Alternatively, the valves may be configured to be closed when the pressure differential between the interior of the diffuser and the interstitial space is below a first threshold, and open when the pressure differential is above a second, different, threshold. In some embodiments, the threshold pressure differentials may be the same for each valve, while in other embodiments, the thresholds may be different for each valve.

Diffuser 220 is a bowl-type diffuser in which the exterior wall 321 curves inward, leaving a space 322 between the exterior wall and the interior wall of the pump housing 230. Space 322 effectively forms a reservoir for fluid in the interstitial space. In this bowl-type diffuser, check valves 331 and 332 are conveniently positioned in a passageway between the upper portion of the diffuser's interior and reservoir 322. In alternative embodiments, the check valves may be positioned in other locations.

As noted above, FIGS. 3A-3C show diffuser 220 in three different states. In FIG. 3A, the pump is operating within an acceptable pressure differential range. Check valves 331 and 332 are therefore both closed. As a result, all of the fluid that is driven through the diffuser by the preceding impeller flows from lower opening 325, through passageways (e.g., 324) to upper opening 326. None of the fluid flows between the interior of the diffuser and the interstitial space.

In FIG. 3B, the pump is shown in a state in which there exists an overpressure condition. That is, the pressure within the diffuser exceeds the pressure in the interstitial space by more than a predetermined threshold differential. As a result, check valve 331 is open, and fluid is allowed to flow from the interior of the diffuser into reservoir 322 in the interstitial space. Check valve 332, which is configured in this embodiment to only allow fluid to flow into the diffuser, is closed. It is assumed in this instance that the pump continues to operate and fluid continues to flow upward through the diffuser (although some of the fluid escapes through valve 331). As fluid escapes through check valve 331, the pressure within the diffuser is reduced. When the pressure within the diffuser has been reduced sufficiently, check valve 331 closes, returning to the state shown in FIG. 3A. This prevents further fluid from flowing out of the diffuser and recirculating through the interstitial space. As noted above, the threshold pressure differential at which check valve closes may be the same as, or different from the threshold at which the valve opens.

In FIG. 3C, the pump is shown in a state in which there exists an underpressure condition. That is, the pressure in the interstitial space exceeds the pressure within the diffuser by more than a predetermined threshold differential. As a result, check valve 332 is open, and fluid is allowed to flow into the interior of the diffuser from reservoir 322 in the interstitial space. Check valve 331, which is configured to allow fluid to flow only out of the diffuser, is closed. It is assumed in this instance that the pump has ceased operating and no fluid is flowing upward through the diffuser, although this is not necessarily the case. As fluid enters the diffuser through check valve 332, the pressure differential between the interior of the diffuser and the interstitial space is reduced. When the pressure differential has been reduced to a threshold level, check valve 332 closes, preventing further fluid from flowing into the diffuser from the interstitial space. This threshold pressure differential may be the same as, or different from the threshold at which valve 332 opens. The threshold pressure differential(s) at which valve 332 opens and closes may be the same as, or different from the threshold(s) at which valve 331 opens and closes.

Figure 4:
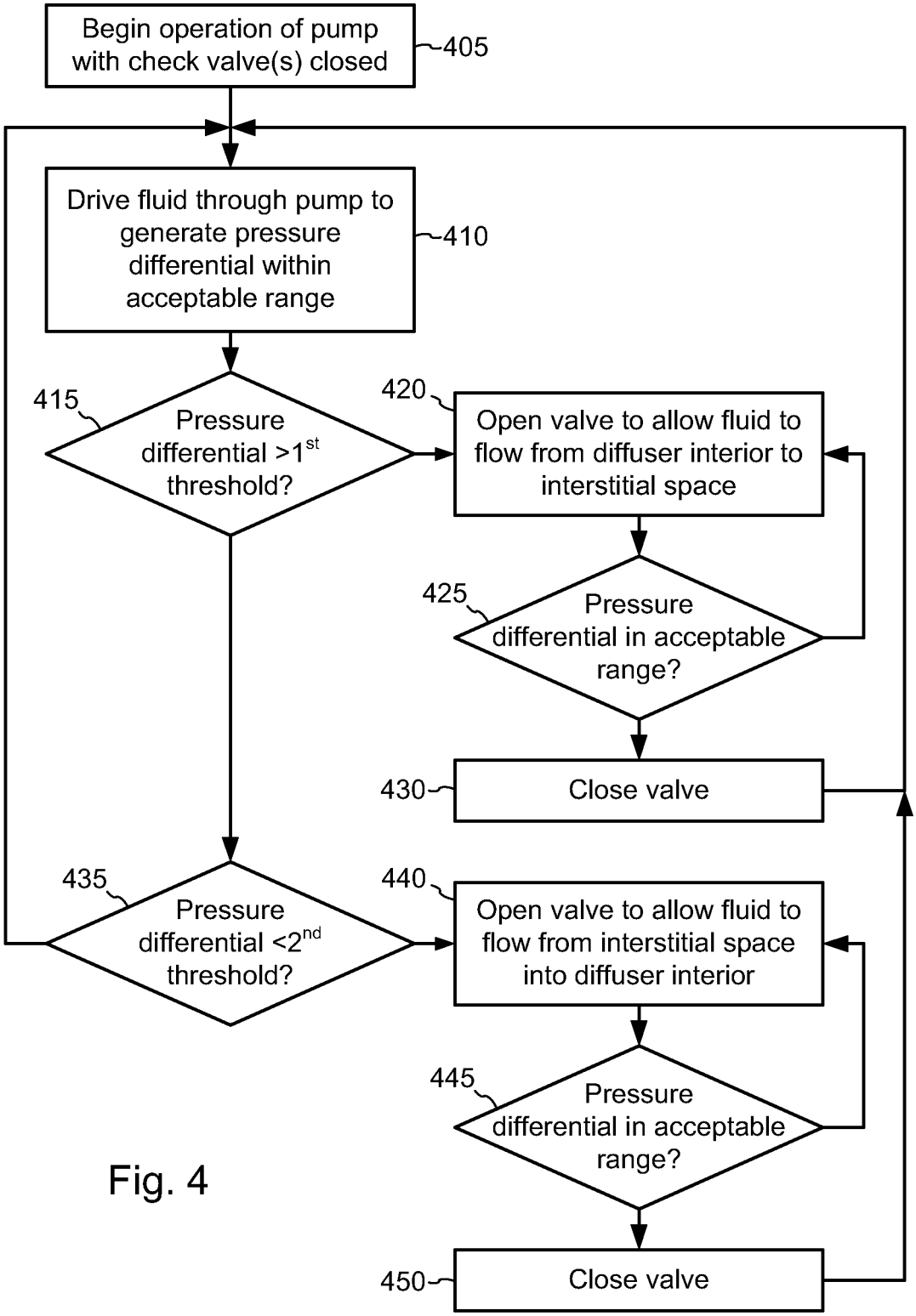
FIG. 4 is a flow diagram illustrating an exemplary method in accordance with one embodiment.

It should be noted that that alternative embodiments of the present invention may include methods for preventing damage to pump diffusers. Referring to FIG. 4, a flow diagram illustrating an exemplary method in accordance with one embodiment is shown. In this embodiment, a pump system such an electric submersible pump begins operation with pressure relief check valves closed (405). The pump includes one or more impeller/diffuser stages. In at least one of these stages, the diffuser incorporates one or more valves that are configured to open and close in response to pressure differential conditions as described above. The pump initially drives fluid through the diffuser to produce a pressure differential in the diffuser that falls within an acceptable pressure differential range (410).

As the pump is operated, it is determined whether the pressure differential exceeds a first threshold level (415). If the pressure differential does not exceed this first threshold, the valves remain closed, and operation of the pump may continue. It is then determined whether the pressure differential falls below a second (negative) threshold level (435). If the pressure differential does not fall below this second threshold, the valves remain closed, and operation of the pump continues (410). It should be noted that the "determinations" of steps 415 and 435 may be passive determinations, such as when a valve remains closed because the pressure differential is insufficient to physically cause the valve to open.

If, in step 415, the pressure differential exceeds the first threshold level, a first one of the valves is opened, allowing fluid to flow out of the diffuser and into the interstitial space (420). When the pressure differential returns to an acceptable range (425), the valve is closed (430), and the pump may continue to operate (410). If, in step 435, the pressure differential falls below the second threshold level, a second one of the valves is opened, allowing fluid to flow into the diffuser from the interstitial space (440). When the pressure differential returns to an acceptable range (445), the valve is closed (450), and the pump may continue to operate (410). As noted above, the valves of this method may be separate, or they may be combined into a single valve. Further, the thresholds to open and close the valves may vary.

While specific embodiments of the present invention have been described Pressure differential above, alternative embodiments may vary from the described embodiments in a number of ways. For example, while the embodiment of FIGS. 3A-3C use two unidirectional check valves, alternative embodiments may include additional valves, or they may utilize a single valve that opens in response to underpressure and overpressure conditions and closes when these conditions are no longer present. The valves may be passively, activated, or they may be operated in response to determinations by control systems in response to appropriate pressure conditions. The positioning of the valves and corresponding fluid communication pathways through the exterior wall of the diffuser may vary in other embodiments. Further, the specific design of the diffuser's walls, vanes, passageways and the like may differ from the particular design shown in FIGS. 3A-3C. Some pump systems may incorporate only diffusers that fall within the scope of this disclosure, while others may incorporate one or more of these diffusers with conventional diffusers. Still other variations will be apparent to those of skill in the art upon reading this disclosure.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. An electric submersible pump system comprising:

a motor; and a pump having a plurality of stages contained within a pump housing, wherein each stage includes an impeller and a diffuser, and wherein in each stage, the diffuser includes one or more check valves between an interior of the diffuser and an interstitial space that is exterior to the diffuser and interior to the pump housing, wherein the interstitial space corresponding to the stage is isolated by one or more seals from the interstitial spaces corresponding to others of the plurality of stages, wherein the one or more check valves remain closed when a pressure differential between the diffuser interior and the interstitial space is within a predetermined range, and wherein the one or more check valves open when the pressure differential between the diffuser interior and the interstitial space is outside the predetermined range, wherein when the one or more check valves are open, fluid communication is enabled between the diffuser interior and the interstitial space;

wherein the one or more check valves include a first unidirectional check valve which remains closed unless an interior pressure within the diffuser exceeds an exterior pressure in the interstitial space by a first predetermined amount, and a second unidirectional check valve which remains closed unless the exterior pressure exceeds the interior pressure by a second predetermined amount.

2. The electric submersible pump system of claim 1, wherein after the one or more check valves open in response to the pressure differential being outside the predetermined range, the one or more check valves reset to a closed position in response to the pressure differential returning to within the predetermined range, wherein when the one or more check valves reset to the closed position, the one or more check valves prevent recirculation of fluid between the diffuser interior and the interstitial space.

3. The electric submersible pump system of claim 1, wherein the pump further comprises one or more seals between each of the plurality of stages and the pump housing, wherein for each of the plurality of stages, the seals isolate the corresponding interstitial space between the stage and the pump housing from the interstitial spaces between other ones of the plurality of stages and the pump housing.

4. The electric submersible pump system of claim 3, wherein the seals comprise elastomeric o-rings.

5. The electric submersible pump system of claim 1, wherein the impeller comprises a centrifugal impeller which imparts kinetic energy to a fluid being driven through the pump and the diffuser converts the kinetic energy of the fluid to pressure.

6. A method for preventing pressure damage to a pump diffuser comprising:

beginning operation of a pump system having one or more stages, each stage having an impeller and a diffuser, wherein the one or more stages are installed within a housing, thereby forming an interstitial space between an exterior of each diffuser and an interior of the housing, wherein the interstitial space corresponding to the stage is isolated from the interstitial spaces corresponding to others of the one or more stages, wherein the impeller of each stage is rotated to produce fluid pressure within the diffuser of said each stage, wherein the diffuser incorporates one or more valves that are configured to open and close in response to pressure differential conditions, and wherein the pump initially produces a pressure differential in the diffuser that falls within an acceptable pressure differential range;

in response to the pressure differential exceeding a first threshold level, opening the one or more valves and thereby enabling fluid to flow from an interior of the diffuser to the interstitial space corresponding to the stage and subsequently closing the valves when the pressure differential returns to an acceptable pressure differential range; and in response to the pressure differential falling below a second threshold level, opening the one or more valves and thereby enabling fluid to flow from the interstitial space corresponding to the stage to the interior of the diffuser and subsequently closing the valves when the pressure differential returns to the acceptable pressure differential range.

7. The method of claim 6, further comprising providing at least one seal between each pair of adjacent stages and thereby isolating a pressure of a corresponding portion of an interstitial space between the stages and a pump housing.

8. An electric submersible pump system comprising:

a motor; and a pump having one or more stages contained within a pump housing, wherein each stage includes an impeller and a diffuser, and wherein the diffuser includes a plurality of check valves between an interior of the diffuser and an interstitial space that is exterior to the diffuser and interior to the pump housing, wherein the plurality of check valves includes a first unidirectional check valve which remains closed unless an interior pressure within the diffuser exceeds an exterior pressure in the interstitial space by a first predetermined amount, and a second unidirectional check valve which remains closed unless the exterior pressure exceeds the interior pressure by a second predetermined amount.

9. The electric submersible pump system of claim 8, wherein each of the one or more stages includes one or more seals positioned between the stage and the pump housing, wherein for each of the one or more stages, the interstitial space corresponding to the stage is isolated from the interstitial spaces corresponding to others of the one or more stages by the one or more seals.

10. The electric submersible pump system of claim 8, wherein after one of the
first unidirectional check valve opens, the first unidirectional check closes in response to the interior pressure within the diffuser no longer exceeding the exterior pressure in the interstitial space by the first predetermined amount, and after the second unidirectional check valve opens, the second unidirectional check valve closes in response to the exterior pressure no longer exceeding the interior pressure by the second predetermined amount.

11. The electric submersible pump system of claim 8, wherein the impeller comprises a centrifugal impeller which imparts kinetic energy to a fluid being driven through the pump and the diffuser converts the kinetic energy of the fluid to pressure.

* * * * *